US006503382B1

(12) United States Patent
Bartlett et al.

(10) Patent No.: US 6,503,382 B1
(45) Date of Patent: Jan. 7, 2003

(54) METHOD OF ELECTRODEPOSITING A POROUS FILM

(75) Inventors: Philip Nigel Bartlett, Hants (GB); John Robert Owen, Southampton (GB); George Simon Attard, Southampton (GB); Joanne Elliott, Southampton (GB)

(73) Assignee: University of Southampton, Southampton (GB)

( * ) Notice: Subject to any disclaimer, the term of this patent is extended or adjusted under 35 U.S.C. 154(b) by 0 days.

(21) Appl. No.: 09/446,725

(22) PCT Filed: Jun. 29, 1998

(86) PCT No.: PCT/GB98/01890

§ 371 (c)(1),
(2), (4) Date: Mar. 20, 2000

(87) PCT Pub. No.: WO99/00536

PCT Pub. Date: Jan. 7, 1999

(30) Foreign Application Priority Data

Jun. 27, 1997 (GB) ..... 9713580
Oct. 30, 1997 (GB) ..... 9722940

(51) Int. Cl.[7] ..... C25D 1/08; C25D 3/02

(52) U.S. Cl. ..... 205/67; 204/483; 204/489; 204/490; 205/75; 205/102; 205/112; 205/220

(58) Field of Search ..... 205/50, 67, 75, 205/102, 112, 220; 204/483, 489, 490; 428/315.5, 613

(56) References Cited

U.S. PATENT DOCUMENTS 4,758,343 A * 7/1988 Sasaki et al. ..... 210/500.28
4,977,038 A * 12/1990 Sieradzki et al. ..... 428/610
5,122,247 A * 6/1992 Kokado et al. ..... 204/181.1
5,250,282 A * 10/1993 Kresge et al. ..... 423/705
5,328,760 A * 7/1994 Gillberg-LaForce ..... 428/315.5
5,538,710 A * 7/1996 Guo et al. ..... 423/701
5,595,715 A * 1/1997 Roth ..... 423/328.1
5,849,215 A * 12/1998 Gin et al. ..... 252/299.01

OTHER PUBLICATIONS

George S. Attard et al, Liquid–Crystal Templates for Nanostructured Metals, Angewandte Chemie. Int. Ed. Engl., vol. 36, No. 12, pp. 1315–1317, 1997 month of publication not available.*

George S. Attard et al, Mesoporous Platinum Films from Lyotropic Liquid Crystalline Phases. Science, vol. 278, pp 838–840, Oct. 31, 1997.*

* cited by examiner

*Primary Examiner*—Nam Nguyen
*Assistant Examiner*—William T. Leader
(74) *Attorney, Agent, or Firm*—Price, Heneveld, Cooper, DeWitt & Litton

(57) ABSTRACT

A method of preparing a porous film comprises electrodepositing material from a mixture onto a substrate, the mixture comprising: (I) a source of metal, inorganic oxide, non-oxide semiconductor/conductor or organic polymer, (II) a solvent such as water; and (III) a structure-directing agent such as octaethylene glycol monododecyl ether in an amount sufficient to form an homogeneous lyotropic liquid crystalline phase in the mixture. Electrodepositing the film from a lyotropic liquid phase in this manner provides a porous film having a substantially regular structure and substantially uniform pore size. Following deposition, the porous film may be treated to remove the structure-directing agent. The porous film may optionally be subjected to further treatment such as the electrochemical or chemical insertion of ionic species, the physical absorption of organic, inorganic or organometallic species, or the electrodeposition, solution phase deposition or gas phase deposition of organic, inorganic or organometallic species.

13 Claims, 1 Drawing Sheet

METHOD OF ELECTRODEPOSITING A POROUS FILM

FIELD OF THE INVENTION

This invention relates to porous films, in particular porous films having a substantially regular structure and uniform pore size, and to a method of preparing porous films by electrodeposition.

BACKGROUND OF THE INVENTION

Porous films and membranes have found extensive applications as electrodes and solid electrolytes in electrochemical devices and sensors. Their open and interconnected microstructure maximises the area over which interaction and/or redox processes can occur, allows electrical conduction, and minimises distances over which mass transport has to occur in order to ensure efficient device operation.

Conventional processes for preparing porous films include the sintering of small particles, deposition from vapour phase reactants, chemical etching and electrodeposition from multicomponent plating solutions. These processes tend to produce materials with a variable pore size, generally in the macroporous range, and with variable thickness of the walls separating the pores. Consequently, these materials may not have sufficiently large specific surface areas, and their irregular structure does not allow for optimum mass transport or electrical conductivity, and may result in poor mechanical and chemical stability.

In the drive towards providing porous films showing improved properties, for use in for example batteries, fuel cells, electrochemical capacitors, light-to-electricity conversion, quantum confinement effect devices, sensors, magnetic devices, superconductors, electrosynthesis and electrocatalysis, to our knowledge no one has yet succeeded in developing an effective process for preparing at least mesoporous films of regular structure and uniform pore size, with the attendant advantages in terms of properties which such films might be expected to show.

For example, previous reported attempts to form polypyrrole films by electrodeposition, from thermotropic liquid crystalline phases, resulted in films of only weakly anisotropic structure.

Previously, we have shown that porous, non-film, materials such as ceramic oxide monoliths and metal powders can be crystallised, gelled or precipitated from lyotropic liquid crystalline phase media, whereby the liquid crystalline phase topology directs the synthesis of the material into a corresponding topology showing structural regularity and uniformity of pore size. However, it was not expected that this templating mechanism could be used to synthesise porous materials other than by simple crystallisation, gelation or precipitation.

What we have found, surprisingly, is that porous films can be prepared from an homogeneous lyotropic liquid crystalline phase by electrodeposition. Surfactants have previously been used as additives in electroplating mixtures in order to enhance the smoothness of electrodeposited films or to prevent hydrogen sheathing (see for example J. Yahalom, O. Zadok, J. Materials Science (1987), vol 22, 499–503). However, in all cases the surfactant was used at concentrations that are much lower than those required to form liquid crystalline phases. Indeed, in these applications high surfactant concentrations were hitherto regarded as undesirable because of the increased viscosities of the plating mixtures.

BRIEF SUMMARY OF THE INVENTION

The present invention in a first aspect provides a method of preparing a porous film which comprises electrodepositing material from a mixture onto a substrate to form a porous film, wherein the mixture comprises:

- a source of metal, inorganic oxide, non-oxide semiconductor/conductor or organic polymer, or a combination thereof;
- a solvent; and
- a structure-directing agent in an amount sufficient to form an homogeneous lyotropic liquid crystalline phase in the mixture, and optionally removing the organic directing agent.

In a second aspect, the invention provides a porous film electrodeposited onto a substrate, wherein the film has a regular structure such that recognisable architecture or topological order is present in the spatial arrangement of the pores in the film, and a uniform pore size such that at least 75% of the pores have pore diameters to within 40% of the average pore diameter.

DETAILED DESCRIPTION OF THE INVENTION

According to the method of the invention, an homogeneous lyotropic liquid crystalline mixture is formed for electrodeposition onto a substrate. The deposition mixture comprises a source material for the film, dissolved in a solvent, and a sufficient amount of an organic structure-directing agent to provide an homogeneous lyotropic liquid crystalline phase for the mixture. A buffer may be included in the mixture to control the pH.

Any suitable source material capable of depositing the desired species onto the substrate by electrodeposition may be used. By "species" in this context is meant metal, inorganic oxide, including metal oxide, non-oxide semiconductor/conductor or organic polymer. Suitable source materials will be apparent to the person skilled in the art by reference to conventional electroplating or electrodeposition mixtures.

One or more source materials may be included in the mixture in order to deposit one or more species. Different species may be deposited simultaneously from the same mixture. Alternatively, different species may be deposited sequentially into layers from the same mixture, by varying the potential such that one or another species is preferentially deposited according to the potential selected.

Similarly, one or more source materials may be used in the mixture in order to deposit one or more materials selected from a particular species or combination of species, either simultaneously or sequentially. Thus, by appropriate selection of source material and electrodeposition regime, the composition of the deposited film can be controlled as desired.

Suitable metals include for example Group IIB, IIIA–VIA metals, in particular zinc, cadmium, aluminium, gallium, indium, thallium, tin, lead, antimony and bismuth, preferably indium, tin and lead; first, second and third row transition metals, in particular platinum, palladium, gold, rhodium, ruthenium, silver, nickel, cobalt, copper, iron, chromium and manganese, preferably platinum, palladium, gold, nickel, cobalt, copper and chromium, and most preferably platinum, palladium, nickel and cobalt; and lanthanide or actinide metals, for example praseodymium, samarium, gadolinium and uranium.

The metals may contain surface layers of, for example, oxides, sulphides or phosphides.

The metals may be deposited from their salts as single metals or as alloys.

Thus, the film may have a uniform alloy composition, for example Ni/Co, Ag/Cd, Sn/Cu, Sn/Ni, Pb/Mn, Ni/Fe or Sn/Li, or if deposited sequentially, a layered alloy structure, for example Co/Cu|Cu/Co, Fe/Co|Co/Fe or Fe/Cr|Cr/Fe, wherein "Co/Cu|Cu/Co" denotes a film containing alternate layers of cobalt-rich alloy and copper-rich alloy. Sequential electrodeposition of species can be achieved according to the method disclosed by Schwarzacher et al., Journal of Magnetism and Magnetic Materials (1997) vol 165, p23–39. For example, an hexagonal phase is prepared from an aqueous solution containing two metal salts A and B, where metal A is more noble than metal B (for example nickel (II) sulphate and copper (II) sulphate) and optionally a buffer (for example boric acid). The deposition potential is alternated from a value only sufficiently negative to reduce A, to one that is sufficiently negative to reduce both A and B. This gives and produces an alternating layered structure consisting of layers A alternating with layers A+B.

Suitable oxides include oxides of for example first, second and third row transition metals, lanthanides, actinides, Group IIB metals, Group IIIA–VIA elements, preferably oxides of titanium, vanadium, tungsten, manganese, nickel, lead and tin, in particular titanium dioxide, vanadium dioxide, vanadium pentoxide, manganese dioxide, lead dioxide and tin oxide.

In some cases, the oxides may contain a proportion of the hydrated oxide i.e. contain hydroxyl groups.

The oxides may be deposited either as single oxides or as mixed oxides, and may optionally be deposited together with a Group IA or Group IIA metal to provide a doped oxide film.

Suitable non-oxide semiconductors/conductors include elemental types such as germanium, silicon and selenium, binary types such as gallium arsenide, indium stibnate, indium phosphide and cadmium sulphide, and other types such as Prussian Blue and analogous metal hexacyanometallates. Electrodeposition of semiconductors can be achieved using the source materials disclosed by: S. K. Das, G. C. Morris, J. Applied Physics (1993), vol 73, 782–786; M. P. R. Panicker, M. Knaster, F. A. Kroger, J. Electrochem. Soc. (1978), vol 125, 566–572; D. Lincot et at., Applied Phys. Letters (1995), vol 67, 2355–2357; M. Cocivera, A Darkowski, B. Love, J. Electrochem. Soc. (1984), vol 131, 2514–2517. J.-F. Guillemoles et al., J. Applied Physics (1996), vol 79, 7293–7302; S. Cattarin, F. Furlanetto, M. M. Musiani, J. Electroanalyt. Chem (1996), vol 415, 123–132; R. Dorin, E. J. Frazer, J. Applied Electrochem. (1998), vol 18, 134–141; M.-C. Yang, U. Landau, J. C. Angus, J. Electrochem. Soc. (1992), vol 139, 3480–3488.

Suitable organic polymers include aromatic and olefinic polymers, for example conducting polymers such as polyaniline, polypyrrole and thiophene, or derivatives thereof These will generally be associated with organic or inorganic counterions, for example chloride, bromide, sulphate, sulphonate, tetrafluoroborate, hexafluorophosphate, phosphate, phosphonate, or combinations thereof.

Other suitable organic materials include insulating polymers such as polyphenol, polyacrylonitrile and poly(orthophenylene diamine).

One or more solvents are included in the mixture in order to dissolve the source material and to form a liquid crystalline phase in conjunction with the structure-directing agent, thereby to provide a medium from which the film may be electrodeposited. Generally, water will be used as the preferred solvent. However, in certain cases it may be desirable or necessary to carry out the electrodeposition in a non-aqueous environment. In these circumstances a suitable organic solvent may be used, for example formamide, ethylene glycol or glycerol.

One or more structure-directing agents are included in the mixture in order to impart an homogeneous lyotropic liquid crystalline phase to the mixture. The liquid crystalline phase is thought to function as a structure-directing medium or template for film deposition. By controlling the nanostructure of the lyotropic liquid crystalline phase, and electrodepositing, a film may be synthesised having a corresponding nanostructure. For example, films deposited from normal topology hexagonal phases will have a system of pores disposed on an hexagonal lattice, whereas films deposited from normal topology cubic phases will have a system of pores disposed in cubic topology. Similarly, films having a lamellar nanostructure may be deposited from lamellar phases.

Accordingly, by exploiting the rich lyotropic polymorphism exhibited by liquid crystalline phases, the method of the invention allows precise control over the structure of the films and enables the synthesis of well-defined porous films having a long range spatially and orientationally periodic distribution of uniformly sized pores.

Any suitable amphiphilic organic compound or compounds capable of forming an homogeneous lyotropic liquid crystalline phase may be used as structure-directing agent, either low molar mass or polymeric. These compounds are also sometimes referred to as organic directing agents. In order to provide the necessary homogeneous liquid crystalline phase, the amphiphilic compound will generally be used at an high concentration, typically at least about 10% by weight, preferably at least 20% by weight, and more preferably at least 30% by weight, based on the total weight of the solvent and amphiphilic compound.

Suitable compounds include organic surfactant compounds of the formula RQ wherein R represents a linear or branched alkyl, aryl, aralkyl or alkylaryl group having from 6 to about 6000 carbon atoms, preferably from 6 to about 60 carbon atoms, more preferably from 12 to 18 carbon atoms, and Q represents a group selected from: $[O(CH_2)_m]_nOH$ wherein m is an integer from 1 to about 4 and preferably m is 2, and n is an integer from 2 to about 100, preferably from 2 to about 60, and more preferably from 4 to 8; nitrogen bonded to at least one group selected from alkyl having at least 4 carbon atoms, aryl, aralkyl and alkylaryl; and phosphorus or sulphur bonded to at least 2 oxygen atoms. Preferred examples include cetyl trimethylammonium bromide, sodium dodecyl sulphate, sodium dodecyl sulphonate and sodium bis(2-ethylhexyl) sulphosuccinate.

Other suitable structure-directing agents include monoglycerides, phospholipids, glycolipids and amphiphilic block copolymers.

Preferably non-ionic surfactants such as octaethylene glycol monododecyl ether ($C_{12}EO_8$, wherein EO represents ethylene oxide), octaethylene glycol monohexadecyl ether ($C_{16}EO_8$) and non-ionic surfactants of the Brij series (trade mark of ICI Americas), are used as structure-directing agents.

In most cases, the source material will dissolve in the solvent domains of the liquid crystalline phase, but in certain cases the source material may be such that it will dissolve in the hydrophobic domains of the phase.

The mixture may optionally further include a hydrophobic additive to modify the structure of the phase, as explained more fully below. Suitable additives include n-heptane, n-tetradecane, mesitylene and triethyleneglycol dimethyl ether. The additive may be present in the mixture in a molar ratio to the structure-directing agent in the range of 0.1 to 10, preferably 0.5 to 2, and more preferably 0.5 to 1.

The mixture may optionally further include an additive that acts as a co-surfactant, for the purpose of modifying the structure of the liquid crystalline phase or to participate in the electrochemical reactions. Suitable additives include n-dodecanol, n-dodecanethiol and perfluorodecanol. The additive may be present in the mixture in a molar ratio to the structure-directing agent in the range of 0.01 to 2, and preferably 0.08 to 1.

The deposition mixture is electrodeposited onto a suitable substrate, for example a polished gold, copper or carbon electrode. The specific electrodeposition conditions of pH, temperature, potential, current density and deposition period will depend on the source material used and the thickness of film to be deposited. Typically, the pH of the deposition mixture is adjusted to a value in the range from I to 14, and preferably in the range from 2 to 6 or from 8 to 12. The current density for galvanostatic deposition is generally in the range from 1 $pA/cm^2$ to 1 $A/cm^2$. Typically, for potentiostatic deposition at fixed potential, the potential applied has a value in the range −10V to +10V, preferably −3V to +3V, and more preferably −1V to +1V, relative to the standard calomel electrode. Typically, for potentiostatic deposition at variable potential, the applied potential is stepped between fixed limits generally within the range from −10V to +10V, relative to the standard calomel electrode, or swept at a rate in the range from 1 mV/s to 100 kV/s. The temperature is generally in the range from 15 to 80° C., preferably 20 to 40° C. The electrodeposition will generally be carried out so as to deposit a film of a thickness from 1 nm (10 Å) to 200 $\mu$m, preferably 2 nm (20 Å) to 100$\mu$m, more preferably 5 nm (50 Å) to 50 $\mu$m, and still more preferably 10 nm (100 Å) to 20$\mu$m.

It will be appreciated that the conditions under which electrodeposition is conducted may be varied so as to control the nanostructure and properties of the deposited film. For example, we have found that the temperature at which electrodeposition is conducted affects the double layer capacitance of the films. Also, the deposition potential affects the regularity of the nanostructure.

Following electrodeposition, it will usually be desirable to treat the film to remove the structure-directing agent, any hydrocarbon additive and co-surfactant, unreacted source material and ionic impurities, for example by solvent extraction or by decomposition in nitrogen and combustion in oxygen (calcination). However, for certain applications such treatment may not be necessary.

The deposited film may then optionally be subjected to further treatment, for example to the electrochemical or chemical insertion of ionic species, to the physical absorption of organic, inorganic or organometallic species, to electrodeposition, solution phase deposition or gas phase deposition of organic, inorganic or organometallic species onto the internal surfaces so as to create thin coatings, or onto the topmost surface, or into the pores so as to fill them partially or completely, to chemical treatment to form surface layers, for example by reaction with hydrogen sulphide gas to form metal sulphide or by adsorption of alkane thiols or other surface active materials, to physical treatment, for example by adsorption of proteins such as enzymes, by deposition of lipid bilayer overlayers as supports for transmembrane or membrane-associated proteins or by doping with Group I or II metals, or to thermal treatment, for example to form nanostructured carbon from electrodeposited polyphenol or polyacrylonitrile films.

It will be appreciated that the film may be used in situ as deposited on the substrate, or may be separated from the substrate after its deposition, according to its intended field of application. If separated, any optional post-deposition treatment of the film may be effected before, during or after separation of the film from the substrate.

It has been found that the pore size of the deposited film can be varied by altering the hydrocarbon chain length of the surfactant used as structure-directing agent, or by supplementing the surfactant by an hydrocarbon additive. For example, shorter-chain surfactants will tend to direct the formation of smaller-sized pores whereas longer-chain surfactants tend to give rise to larger-sized pores. The addition of an hydrophobic hydrocarbon additive such as n-heptane, to supplement the surfactant used as structure-directing agent, will tend to increase the pore size, relative to the pore size achieved by that surfactant in the absence of the additive. Also, the hydrocarbon additive may be used to alter the phase structure of the liquid crystalline phase in order to control the corresponding regular structure of the deposited film.

Using the method according to the invention, regular porous films that are conducting or semiconducting phases can be prepared with pore sizes in mesoporous and macroporous ranges, possibly up to a pore size of about 30 nm (300 Å). By "mesoporous" as referred to herein is meant a pore diameter within the range from about 1.3 to 20 nm (13 to 200 Å), and by "macroporous" is meant pore diameters exceeding about 20 nm (200 Å). Preferably, the films are mesoporous, more preferably having a pore diameter within the range from 1.4 to 10 nm (14 to 100 Å), and most preferably within the range from 1.7 to 4 nm (17 to 40 Å).

The films in accordance with the invention may exhibit pore number densities in the range from $1\times10^{10}$ to $1\times10^{14}$ pores per $cm^2$, preferably from $4\times10^{11}$ to $3\times10^{13}$ pores per $cm^2$, and more preferably from $1\times10^{12}$ to $1\times10^{13}$ pores per $cm^2$.

The porous film has pores of substantially uniform size. By "substantially uniform" is meant that at least 75% of pores have pore diameters to within 40%, preferably within 30%, more preferably within 10%, and most preferably within 5%, of average pore diameter.

The film in accordance with the invention is of a substantially regular structure. By "substantially regular" as used herein is meant that a recognisable topological pore arrangement is present in the film. Accordingly, this term is not restricted to ideal mathematical topologies, but may include distortions or other modifications of these topologies, provided recognisable architecture or topological order is present in the spatial arrangement of the pores in the film. The regular structure of the film may for example be cubic, lamellar, oblique, centred rectangular, body-centred orthorhombic, body-centred tetragonal, rhombohedral, hexagonal, or distorted modifications of these. Preferably the regular structure is hexagonal.

BRIEF DESCRIPTION OF THE DRAWINGS

The films obtainable in accordance with the present invention may be further illustrate with reference to the accompanying drawings in which.

Figure 1:
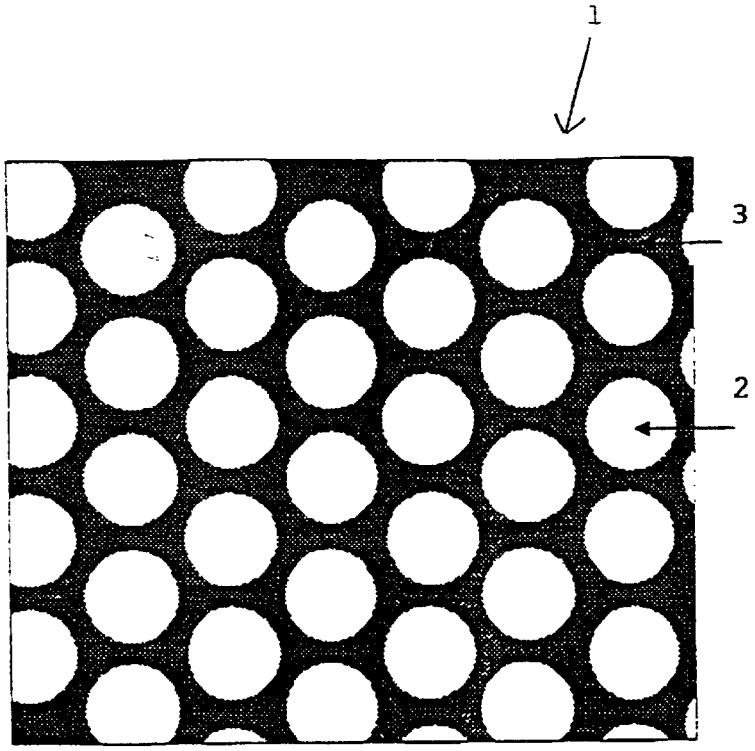
FIG. 1 is a schematic representation of a mesoporous film that has an hexagonal structure.

In the embodiment illustrated in FIG. 1, the film 1 has an hexagonal arrangement of open channels 2 that can be synthesised with internal diameters of about 1.3 to about 20 nm (about 13 Åto about 200 Å) in a metal, inorganic oxide, non-oxide semiconductor/conductor, or organic polymer matrix 3. The term "hexagonal" as used herein encompasses not only materials that exhibit mathematically perfect hexagonal symmetry within the limits of experimental measurement, but also those with significant observable deviations from the ideal state, provided that most channels are surrounded by an average of six nearest-neighbour channels at substantially the same distance.

Figure 2:
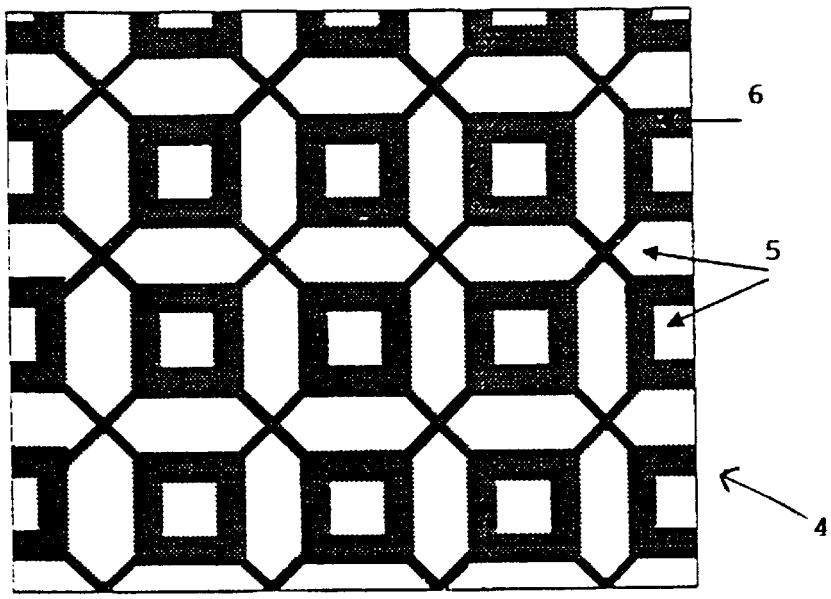
FIG. 2 is a schematic representation of a mesoporous film that has a cubic nanostructure.

A further embodiment illustrated in FIG. 2 shows a film 4 with a cubic arrangement of open channels 5 that can be synthesised with internal diameters of about 1.3 to about 20 nm (about 13 Åto about 200 Å) in a metal, inorganic oxide, non-oxide semiconductor/conductor, or organic polymer matrix 6. The term "cubic" as used herein encompasses not only materials that exhibit mathematically perfect symmetry belonging to cubic space groups within the limits of experimental measurement, but also those with significant observable deviations from the ideal state, provided that most channels are connected to between two and six other channels.

In their solvent-extracted forms the films obtainable by the method of the invention may be characterised by an X-ray diffraction pattern with at least one peak at a position greater than about 1.8 nm (18 Å) units d-spacing (4.909 degrees two-theta for Cu K-alpha radiation) and by examination using transmission electron microscopy or scanning tunnelling microscopy. Transmission electron microscopy typically shows that the size of the pores is uniform to within 30% of the average pore size.

Metallic films prepared by the method of the present invention may be expressed by the empirical formula:

$$M_xA_h$$

wherein M is a metallic element, such as a metal from Groups IIB and IIIA–VIA, in particular zinc, cadmium, aluminium, gallium, indium, thallium, tin, lead, antimony and bismuth, preferably indium, tin and lead; a first, second and third row transition metal, in particular platinum, palladium, gold, rhodium, ruthenium, silver, nickel, cobalt, copper, iron, chromium and manganese, preferably platinum, palladium, gold, nickel, cobalt, copper and chromium, and most preferably platinum, palladium, nickel and cobalt; a lanthanide or actinide metal, for example praseodymium, samarium, gadolinium and uranium; or a combination thereof, x is the number of moles or mole fraction of M, A is oxygen, sulphur, or hydroxyl, or a combination thereof, and h is the number of moles or mole fraction of A.

Preferably x is greater than h, and particularly preferably the ratio h/x is in the range 0 to 0.4.

Oxide films prepared by the method of the present invention may be expressed by the empirical formula:

$$M_xB_yA_h$$

wherein M is an element such as a first, second and third row transition metal, lanthanide, actinide, Group IIB metal, Group IIIA–VIA element, in particular vanadium dioxide, vanadium pentoxide, lead dioxide, tin oxide, manganese dioxide and titanium dioxide, and preferably oxides of titanium, vanadium, tungsten, manganese, nickel, lead and tin, or a combination thereof, B is a metal from Group IA or Group IIA, or a combination thereof, A is oxygen, sulphur, or hydroxyl, or a combination thereof, x is the number of moles or mole fraction of M, y is the number of moles or mole fraction of B, and h is the number of moles or mole fraction of A.

Preferably h is greater than or equal to x+y, and particularly preferably the ratio h/x+y is in the range 1 to 8 and the ratio y/x is in the range 0 to 6.

Non-oxide semiconductor/conductor films prepared by the method of the present invention may be expressed by the empirical formulae:

$$M_xD_h \quad \text{(i)}$$

wherein M is selected from cadmium, indium, tin and antimony, D is sulphur or phosphorus, and the ratio x/h is in the range 0.1 to 4, and preferably in the range 1 to 3;

$$M_xE_y \quad \text{(ii)}$$

wherein M is a Group III element such as gallium or indium, E is a Group V element such as arsenic or antimony, and the ratio x/y is in the range 0.1 to 3, and preferably in the range 0.6 to 1;

$$M_xA_h \quad \text{(iii)}$$

wherein M is an element from Groups III to VI such as gallium, germanium or silicon, A is oxygen, sulphur or hydroxyl, or a combination thereof, x is preferably greater than h, and particularly preferably the ratio h/x is in the range 0 to 0.4;

$$M_xN_y(CN)_6B_2 \quad \text{(iv)}$$

wherein M and N are elements independently selected from second and third row transition metals provided that M and N are in different formal oxidation states, B is an element from Group I or II or is ammonium, the ratio x/y is in the range 0.1 to 2, preferably in the range 0.3 to 1.3, and the ratio z/(x+y) is in the range 0.5 to 1.

Polymeric films prepared by the method of the present invention may be expressed by the empirical formula:

$$M_xC_h$$

wherein M is an aromatic or olefinic polymer, for example polyaniline, polypyrrole, polyphenol or polythiophene, or is polyacrylonitrile or poly(ortho-phenylene diamine), C is an organic or inorganic counterion, for example chloride, bromide, sulphate, sulphonate, tetrafluoroborate, hexafluorophosphate, phosphate or phosphonate, or a combination thereof, x is the number of moles or mole fraction of M and h is the number of moles or mole fraction C. Preferably x is greater than h, particularly preferably the ratio h/x is in the range 0 to 0.4.

In the as-synthesised form the films prepared by the method of this invention have a composition, on an anhydrous basis, expressed empirically as follows:

$$S_qM_xA_h$$

$$S_qM_xB_yA_h$$

$$S_qM_xD_h$$

$S_qM_xE_y$ $S_qM_xN_y(CN)_6B_z$ $S_qM_xC_h$ wherein S is the total organic directing material, q is the number of moles, or mole fraction, of S, and $M_xA_h$, $M_xB_yA_h$, $M_xD_h$, $M_xE_y$, $M_xN_y(CN)_6B_z$ and $M_xC_h$ are as defined above.

The S component is associated with the materials as a result of its presence during the synthesis, and, as already mentioned, may easily be removed by extraction with solvent or by decomposition in nitrogen and combustion in oxygen (calcination).

The porous films in accordance with the invention may have pores of uniform diameter, in contrast to hitherto obtainable porous films. Also, the porous films according to the invention may have architectures which hitherto could not be obtained by other electrodeposition processes. Furthermore, the porous films may have high specific surface areas, high double layer capacitances and provide a low effective series resistance to electrolyte diffusion. Porous films may be prepared which exhibit greater mechanical, electrochemical, chemical and thermal durability than porous films obtained by other methods.

The porous films in accordance with the invention may have applications as follows: in sensors such as gas sensors, for example for carbon monoxide, methane, hydrogen sulphide, or in "electronic nose" applications, chemical sensors, for example for process control in the chemicals industry, and biosensors, for example for glucose or therapeutic drugs; in energy storage cells and batteries, for example as anode or cathode electrodes or solid electrolyte; in solar cells, for example as collectors or supports for organometallic species; in electrochromic devices such as display devices or smart windows as electrodes or solid electrolytes or electroactive components; in field emitters, for example display devices or electronic devices; as nanoelectrodes, for example for electrochemical studies; in electrocatalysis, for example in enzyme mimicry or "clean synthesis" of pharmaceuticals; in magnetic devices, for example magnetic recording media or giant magnetoresistive media; in optical devices such as non-linear optical media, evanescent wave devices, surface plasmon polariton devices, or optical recording media; for scientific applications such as in surface enhanced optical processors, chemical reactions in confined geometries, or physical processes in confined geometries; for chemical separations, for example in gas separation, electrostatic precipitators, electrochemical separators or electrophoresis; and in devices for the controlled delivery of therapeutic agents.

Also, deposited film may be used as a template for the chemical or electrochemical production of other porous films or powders, for example, by filling or coating the pores with an organic or inorganic material and subsequently removing the material of the original deposited film by electrochemical or chemical dissolution or by thermal treatment. Optionally, the filled or coated films may be subjected to chemical or physical treatments to modify their chemical composition prior to the removal of the material from the original film.

The method and porous film according to the invention may be further illustrated by reference to the following examples:

EXAMPLE 1

Best Mode

Electrodeposition of Platinum From an Hexagonal Liquid Crystalline Phase 3 grams of octaethylene glycol monohexadecyl ether ($C_{16}EO_8$) surfactant were added to 2.0 grams of water and 2.0 grams of hexachloroplatinic acid hydrate in water. The mixture was heated and shaken vigorously until a homogeneous mixture was obtained. Electrodeposition from this mixture was carried out at temperatures between 25° C. and 85° C. onto a 0.000314 centimetre squared polished gold electrode by stepping the potential from +0.6 volt vs standard calomel electrode to −0.1 volt vs standard calomel electrode until a charge of −2 millicoulomb was passed. The surfactant was removed by rinsing with distilled water. A film having a metallic structure was obtained, which upon examination by transmission electron microscopy was found to have an hexagonal disposition of pores with internal diameters of 2.5 (±0.15) nm (25 (±1.5) Å) separated by metal walls of 2.5 (±0.2) nm (25 (±2) Å) width.

EXAMPLE 2

Electrodeposition of Platinum From an Hexagonal Liquid Crystalline Phase

The process of Example 1 was carried out using the shorter-chain surfactant $C_{12}EO_8$ in place of $C_{16}EO_8$. The pore diameters as determined by TEM were found to be 1.75 (±0.2) nm (17.5 (±2) Å).

EXAMPLE 3

Electrodeposition of Platinum From an Hexagonal Liquid Crystalline Phase

The process of Example 1 was repeated using a quaternary mixture containing $C_{16}EO_8$ and n-heptane in the molar ratio 2:1. As determined by TEM, the pore diameters were found to be 3.5 (±0.15) nm (±(±1.5) Å).

EXAMPLE 4

Electrodeposition of Tin From an Hexagonal Liquid Crystalline Phase

A mixture having normal topology hexagonal phase at 22° C. was prepared from 50 wt % of a mixture containing 0.1 M tin(II) sulphate and 0.6 M sulphuric acid, and 50 wt % of octaethylene glycol monohexadecyl ether ($C_{16}EO_8$). Electrodeposition onto polished gold electrodes and onto copper electrodes was carried out potentiostatically at 22° C. using a tin foil counterelectrode. The cell potential difference was stepped from the open-circuit value to between −50 and −100 mV until a charge of 0.5 coulombs per centimetre squared was passed. After deposition the films were rinsed with copious amounts of absolute ethanol to remove the surfactant. The washed nanostructured deposits were uniform and shiny in appearance. Small angle X-ray diffraction studies of the electrodeposited tin revealed a lattice periodicity of 3.8 nm (38 Å).

EXAMPLE 5

Electrodeposition of Tin From an Hexagonal Liquid Crystalline Phase

The process of Example 5 was repeated using a mixture having normal topology hexagonal phase at 22° C. prepared from 47 wt % of a mixture containing 0.1 M tin(II) sulphate and 0.6 M sulphuric acid, and 53 wt % of a mixture containing octaethylene glycol monohexadecyl ether ($C_{16}EO_8$) and n-heptane in a molar ratio 1:0.55. The washed nanostructured deposits were uniform and shiny in appearance. Small angle X-ray diffraction studies of the electrodeposited tin revealed a lattice periodicity of 6 (±0.3)nm (60 (±3) Å).

EXAMPLE 6

Electrodeposition of Platinum From a Cubic Liquid Crystalline Phase

A mixture having normal topology cubic phase (indexing to the Ia3d space group) was prepared from 27 wt % of an aqueous solution of hexachloroplatinic acid (33 wt % with respect to water) and 73 wt % of octaethylene glycol monohexadecyl ether ($C_{16}EO_8$). Electrodeposition onto polished gold electrodes was carried out potentiostatically at temperatures between 35° C. and 42° C. using a platinum gauze counterelectrode. The cell potential difference was stepped from +0.6 V versus the standard calomel electrode to −0.1 V versus the standard calomel electrode until a charge of 0.8 millicoulombs was passed. After deposition the films were rinsed with copious amounts of deionised water to remove the surfactant. The washed nanostructured deposits were uniform and shiny in appearance. Transmission electron microscopy studies revealed a highly porous structure consisting of a three-dimensional periodic network of cylindrical holes with internal diameters of 2.5 nm (25 Å).

EXAMPLE 7

Electrodeposition of Nickel From an Hexagonal Liquid Crystalline Phase

A mixture having normal topology hexagonal phase was prepared from 50 wt % of an aqueous solution of 0.2 M nickel (II) sulphate, 0.58 M boric acid, and 50 wt % of octaethylene glycol monohexadecyl ether ($C_{16}EO_8$). Electrodeposition onto polished gold electrodes was carried out potentiostatically at 25° C. using a platinum gauze counterelectrode. The cell potential difference was stepped to −1.0 V versus the saturated calomel electrode until a charge of 1 coulomb per centimetre squared was passed. After deposition the films were rinsed with copious amounts of deionised water to remove the surfactant. The washed nanostructured deposits were uniform and shiny in appearance. Small angle X-ray diffraction studies of the electrodeposited tin revealed a lattice periodicity of 5.8 nm (58 Å), while transmission electron microscopy studies revealed a highly porous structure consisting of cylindrical holes with internal diameters of 3.4 nm (34 Å) separated by nickel walls 2.8 nm (28 Å) thick.

EXAMPLE 8

Electrodeposition of Insulating Poly[ortho-phenylene Diamine] From an Hexagonal Liquid Crystalline Phase A mixture having normal topology hexagonal phase was prepared from 50 wt % of a solution of 10 mM o-phenylene diamine, 0.1 M potassium chloride and 0.1 M phosphate buffer, and 50 wt % of octaethylene glycol monohexadecyl ether ($C_{16}EO_8$). Electrodeposition onto polished gold electrodes and glassy carbon electrodes was carried out by cyclic voltammetry at 20° C. using a platinum gauze counterelectrode. The cell potential difference was swept between 0 V and +1 V versus the standard calomel electrode for 8 cycles at 50 mV per second, terminating at 0 V on the last cycle. After deposition the films were rinsed with copious amounts of deionised water to remove the surfactant. The washed nanostructured deposits were analysed by comparing redox couple curves for the reduction of 1mM potassium ferricyanide (in 0.1 M aqueous potassium chloride) to potassium ferrocyanide, and of 5 mM hexa-amine ruthenium (III) chloride complex (in 0.1 M aqueous potassium chloride). The films were found to affect the reduction/oxidation of the ferri/ferrocyanide system but not of the ruthenium system, indicating that the latter species cannot access the bare electrode present at the bottom of the pores in the poly(o-phenylene diamine) film. Polymer films produced in the absence of templates were found to block both types of redox reactions.

EXAMPLE 9

Electrodeposition of Lead Dioxide From an Hexagonal Liquid Crystalline Phase

A mixture having normal topology hexagonal phase was prepared from 50 wt % of a 1 M lead(II)acetate solution in water and 50 wt % Brij 76 non-ionic surfactant. Electrodeposition onto polished gold electrodes was carried out potentiostatically at 25° C. using a platinum gauze counterelectrode. The cell potential difference was stepped between +1.4 V and +2.1 V until a charge of 1.38 coulombs per centimetre squared was passed. After deposition the films were rinsed with copious amounts of water to remove the surfactant. The washed nanostructured deposits were uniform and matt grey in appearance. Small angle X-ray diffraction studies of the electrodeposited tin revealed a lattice periodicity of 4.1 nm (41 Å).

EXAMPLE 10

Depositions were carried out on gold plate electrodes at 25° C. at a deposition potential of −0.1V vs SCE (stepped from +0.6 V) from an hexagonal liquid crystalline phase consisting of 2.0 g $H_2O$, 3.0 g $C_{16}EO_8$ and 2.0 g hexachloroplatinic acid. Thickness data were obtained by inspection of fractured samples using scanning electron microscopy. The results are shown in Table 1 below:

TABLE 1

Relationship between charge density and nanostructured platinum film thickness.

| Charge density ($C\ cm^{-2}$) | Film Thickness (nm) |
|---|---|
| 0.64 | 92 |
| 1.0 | 277 |
| 2.0 | 517 |
| 4.00 | 744 |
| 6.37 | 1849 |
| 21.98 | 15455 |

EXAMPLE 11

Nanostructured platinum films were deposited from an hexagonal liquid crystalline phase consisting of 2.0 g $H_2O$, 3.0 g $C_{16}EO_8$ and 2.0 g hexachloroplatinic acid. Depositions were carried out on 0.2 mm diameter gold disc electrodes at a deposition potential of −0.1 V vs SCE (stepped from +0.6 V). The charge passed was 6.37 C $cm^{31\ 2}$ Data were obtained from cyclic voltammetry in 2M sulphuric acid between potential limits −0.2 V and +1.2 V vs SCE. The Roughness Factor is defined as the surface area determined from electrochemical experiments divided by the geometric surface area of the electrode. The results are shown in Table 2 below:

TABLE 2

Effect of temperature on Roughness Factor and double layer capacitance.

| Temperature (° C.) | Roughness Factor | Capacitance ($\mu$F cm$^{-2}$) |
|---|---|---|
| 25 | 305 | 25510 |
| 35 | 379 | 29936 |
| 40 | 457 | 37580 |
| 50 | 517 | 40127 |
| 65 | 540 | 45541 |
| 75 | 581 | 55733 |
| 85 | 711 | 63376 |

EXAMPLE 12

Nanostructured platinum films were deposited from an hexagonal liquid crystalline phase consisting of 2.0 g $H_2$ O, 3.0 g $C_{16}EO_8$ and 2.0 g hexachloroplatinic acid. Depositions were carried out on 0.2 mm diameter gold disc electrodes at a deposition potential indicated (stepped from +0.6 V). The charge passed was 6.37 C cm$^{-2}$ Data were obtained from cyclic voltammetry in 2M sulphuric acid between potential limits −0.2 V and +1.2 V vs SCE. The results are shown in Table 3 below:

TABLE 3

Effect of deposition potential on Roughness Factor and double layer capacitance.

| $E_2$ (V (vs SCE)) | Roughness Factor | Capacitance ($\mu$F cm$^{-2}$) |
|---|---|---|
| +0.1 | 34 | 4086 |
| 0.0 | 86 | 9268 |
| −0.1 | 261 | 26105 |
| −0.2 | 638 | 66783 |
| −0.3 | 35 | 3924 |
| −0.4 | 24 | 2250 |

The data in Examples 1 to 5 show how pore diameter can be controlled by variation of the chain length of the surfactant or by further addition of a hydrophobic hydrocarbon additive.

Comparison of Example 1 with Example 2 demonstrates that the pore size may be decreased by using a shorter-chain surfactant, whereas comparison of Example 1 with Example 3, and of Example 4 with Example 5, shows that the pore size may be increased by the addition of a hydrocarbon additive to the deposition mixture.

Example 10 demonstrates how the thickness of the deposited film may be controlled by varying the charge passed during electrodeposition.

Examples 11 and 12 show how the temperature and applied potential during electrodeposition affect the surface area and the double layer capacitance of the film.

As indicated by the Roughness Factor values, increasing the deposition temperature increases both the surface area and the double layer capacitance of the film. At the same time, the deposition potential may be so selected as to control the surface area and capacitance of the deposited film.

What is claim is:

1. A method of preparing a porous film which comprises electrodepositing material from a mixture onto a substrate to form a porous film, wherein the mixture comprises:

a source of metal, inorganic oxide, non-oxide semiconductor/conductor or organic polymer, or a combination thereof;

a solvent; and a structure-directing agent in an amount sufficient to form an homogeneous lyotropic liquid crystalline phase in the mixture, and optionally removing the structure-directing agent.

2. A method according to claim 1 wherein the mixture comprises a lyotropic liquid crystalline phase exhibiting a hexagonal or cubic topology.

3. A method according to claim 1 wherein the mixture comprises a source of a metal selected from the group consisting of platinum, palladium, gold, nickel, cobalt, copper, chromium, indium, tin and lead.

4. A method according to claim 1 wherein the mixture comprises a source of an oxide of a metal selected from the group consisting of titanium, vanadium, tungsten, manganese, nickel, lead and tin.

5. A method according to claim 1 wherein the mixture comprises a source of a non-oxide semiconductor or conductor selected from the group consisting of germanium, silicon, selenium, gallium arsenide, indium stibnate, indium phosphide, cadmium sulphide and metal hexacyanometallates.

6. A method according to claim 1 wherein the mixture comprises a source of an organic polymer selected from the group consisting of polyaniline, polypyrrole, polythiophene, polyphenol, polyacrylonitrile, poly(ortho-phenylene diamine) and derivatives thereof.

7. A method according to claim 1 wherein the solvent is water.

8. A method according to claim 1 wherein the structure-directing agent is octaethylene glycol monododecyl ether or octaethylene glycol monohexadecyl ether.

9. A method according to claim 1 wherein the structure-directing agent is present in the mixture in an amount of at least 20% by weight based on the total weight of the solvent and structure-directing agent.

10. A method according to claim 1 wherein the mixture further comprises a hydrophobic hydrocarbon additive to control the pore diameter and/or regular structure of the deposited film.

11. A method according to claim 10 wherein the hydrocarbon is present in the mixture in a molar ratio to the structure-directing agent in the range of 0.5 to 1.

12. A method according to claim 1 wherein an electrodeposition potential is varied to deposit the material sequentially into layers.

13. A method according to claim 1 wherein the structure-directing agent is present in the mixture in an amount of at least 30% by weight based on the total weight of the solvent and structure-directing agent.

* * * * *